US007237870B2

(12) United States Patent
Chen

(10) Patent No.: US 7,237,870 B2
(45) Date of Patent: Jul. 3, 2007

(54) OFFICE MACHINE

(75) Inventor: Chih-Hung Chen, Tainan (TW)

(73) Assignee: BENQ Corporation, Taoyuan (TW)

( * ) Notice: Subject to any disclaimer, the term of this patent is extended or adjusted under 35 U.S.C. 154(b) by 290 days.

(21) Appl. No.: 10/858,155

(22) Filed: Jun. 1, 2004

(65) Prior Publication Data

US 2004/0246297 A1 Dec. 9, 2004

(30) Foreign Application Priority Data

Jun. 3, 2003 (TW) ..... 92210190 U

(51) Int. Cl.
*B41J 23/00* (2006.01)

(52) U.S. Cl. ..... 347/37; 400/335

(58) Field of Classification Search ..... 347/37, 347/38, 39; 400/335
See application file for complete search history.

(56) References Cited

U.S. PATENT DOCUMENTS

| | | | | |
|---|---|---|---|---|
| 4,484,485 | A | 11/1984 | Matsuhisa | |
| 4,746,237 | A | 5/1988 | Takeda | |
| 5,871,292 | A * | 2/1999 | Johnson et al. | 400/328 |
| 6,508,534 | B1 | 1/2003 | Yusef et al. | |
| 6,523,931 | B1 * | 2/2003 | Cipolla et al. | 347/30 |

FOREIGN PATENT DOCUMENTS

| | | | |
|---|---|---|---|
| DE | 1044115 | | 5/1959 |
| DE | 2218409 | | 3/1974 |
| DE | 3141406 | C2 | 7/1983 |
| JP | 62191171 | A * | 8/1987 |
| JP | 10076731 | A | 3/1998 |
| JP | 2001171193 | A | 6/2001 |

* cited by examiner

*Primary Examiner*—Stephen Meier
*Assistant Examiner*—Jason Uhlenhake
(74) *Attorney, Agent, or Firm*—Quintero Law Office

(57) ABSTRACT

An office machine. The office machine includes a main body, a shaft, a recording head, a driving wheel, a driven wheel, a tension buffer and a transmission belt. The shaft is disposed on the main body. The recording head is slidably disposed on the shaft. The driving and driven wheels are disposed on each end of the shaft respectively. The tension buffer is disposed on the main body and includes a sleeve, a wheel mount, and a resilient member. The sleeve is disposed on the main body and has a cavity. The wheel mount is disposed in the cavity and connected to the driven wheel. The resilient member is disposed between the sleeve and the wheel mount to move the wheel mount sliding in the sleeve. The transmission belt is disposed between Transmission and driven wheels and joined with the recording head. The driving wheel drives the transmission belt such that the recording head slides on the shaft.

14 Claims, 4 Drawing Sheets

OFFICE MACHINE

BACKGROUND

The present invention relates to an office machine and in particular to a tension buffer in the office machine which prevents belt from loosening or tensing when a recording head accelerates or decelerates.

FIG. 1 shows a conventional apparatus for controlling a recording head in an office machine. The conventional apparatus for controlling a recording head in an office machine includes a main body 10, a driving wheel 11, a belt 12, and a driven wheel 13, wherein the driving wheel 11, belt 12, and driven wheel 13 are disposed on the main body 10. The belt 12 links the driving wheel 11 and the driven wheel 13, and the driving wheel 11 is powered by a motor 16. A recording head 14 is slidably joined on a shaft 15 and bound to the belt 12. The driving wheel 11 drives the recording head 14 to slide on the shaft 15 through the belt 12 to spray ink.

Conventionally, the driven wheel 13 is driven by the driving wheel 11 so that the belt 12 has a predetermined tension. A resilient member 131 of the driven wheel 13 is used to balance tension. As shown in FIG. 1, when the office machine operates, the recording head 14 moves along the shaft by accelerating or decelerating. With long term use and impact, the distance between the driving wheel 11 and driven wheel 13 is altered. The driven wheel 13 is fixed by a screw 132, and the screw 132 may also be damaged. Thus, the driven wheel 13 is unable to return to the original position and the belt 12 may become too slack, or too tight. The driven wheel 13 may also be fixed by a power spring with high tension, which is detrimental as the load on the motor increases, inhibiting office machine performance.

SUMMARY

An object of the present invention is to provide an office machine that solves the above mentioned problem.

The office machine of the present invention includes a main body, a shaft, a recording head, a driving wheel, a driven wheel, a tension buffer and a transmission belt. The shaft is suspended from the main body. The recording head is slidably disposed on the shaft. The driving and driven wheels are disposed on each end of the shaft respectively. The tension buffer is disposed on the main body and includes a sleeve, a wheel mount, and a resilient member. The sleeve is disposed on the main body and has a cavity. The wheel mount is disposed in the cavity and connected to the driven wheel. The resilient member is disposed between the sleeve and the wheel mount allowing the wheel mount to slide in the sleeve. The transmission belt connects the driving wheel and the driven wheel and the recording head bound thereon. The driving wheel drives the transmission belt such that the recording head slides on the shaft.

The office machine of the present invention further includes a seal disposed on the wheel mount such that the cavity is sealed by the wheel mount and the seal.

In the office machine of the present invention, the sleeve has a hole.

Accordingly, the office machine further includes a pin blocking the hole.

The office machine further includes a fastener and a tab disposed on the sleeve, wherein the fastener fixes tension buffer on the main body through tabs. Preferably the fastener is a screw or hook and the resilient member is a spring. The office machine according to the inventions can be a printer, in which case the recording head is a print head, or alternatively can be a scanner, in which case the recording head is a scan module. The print or recording head travels on a shaft and moves on the shaft by a leather belt.

The office machine of the present invention has the following advantages. The sleeve in tension buffer helps to cushion the resilient member when deformed to prevent large and rapid deformation. When the motion of the transmission belt is near uniform, the resilient member is powerful enough to push the driven wheel back to its point of origin. Thus, the present invention operates at higher speed and reduces acceleration and deceleration time, enabling the recording head to move quickly.

DESCRIPTION OF THE DRAWINGS

An embodiment of the present invention can be more fully understood by reading the subsequent detailed description in conjunction with the examples and references made to the accompanying drawings, wherein.

DETAILED DESCRIPTION

Figure 1:
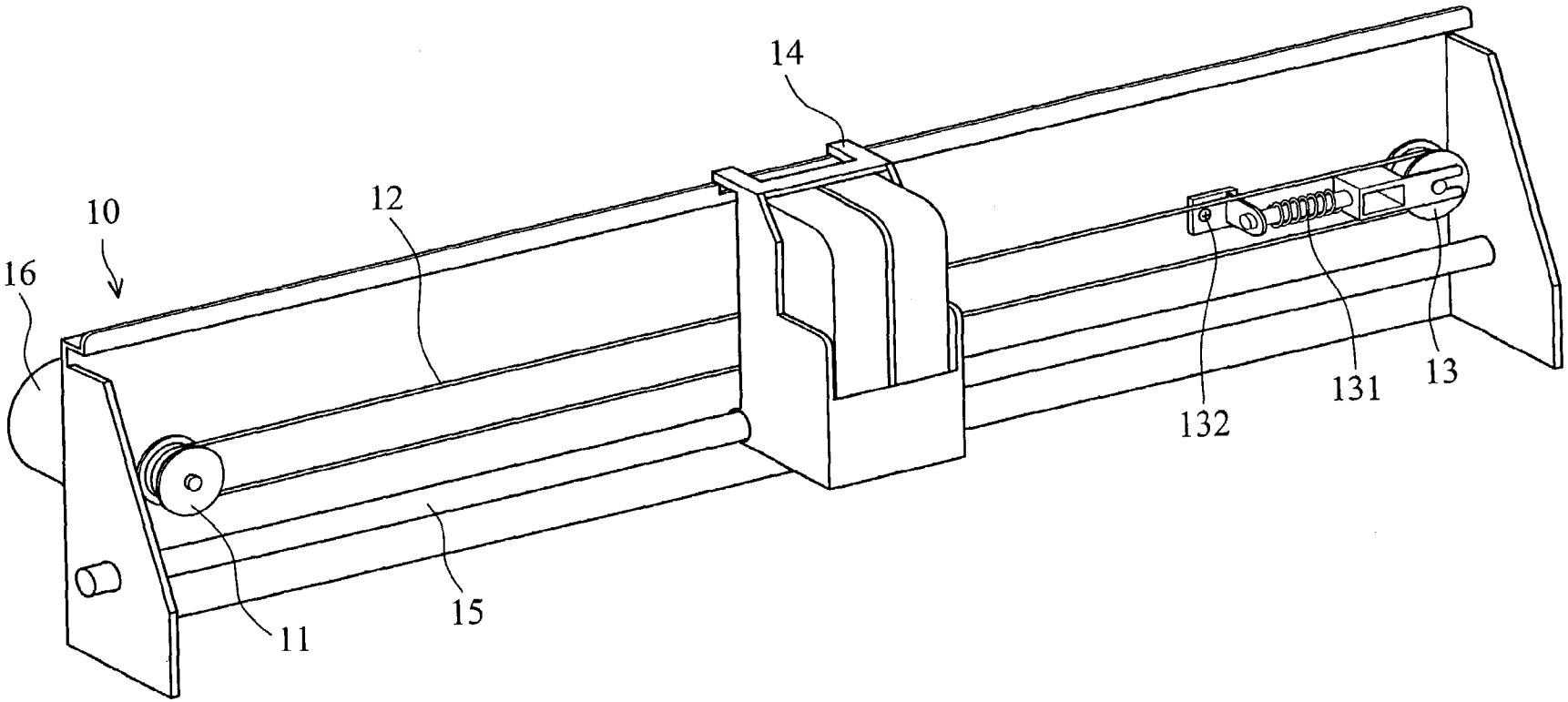
FIG. 1 (RELATED ART)
FIG. 1 is a schematic diagram showing a recording head transmission device in a conventional office machine.
Figure 2:
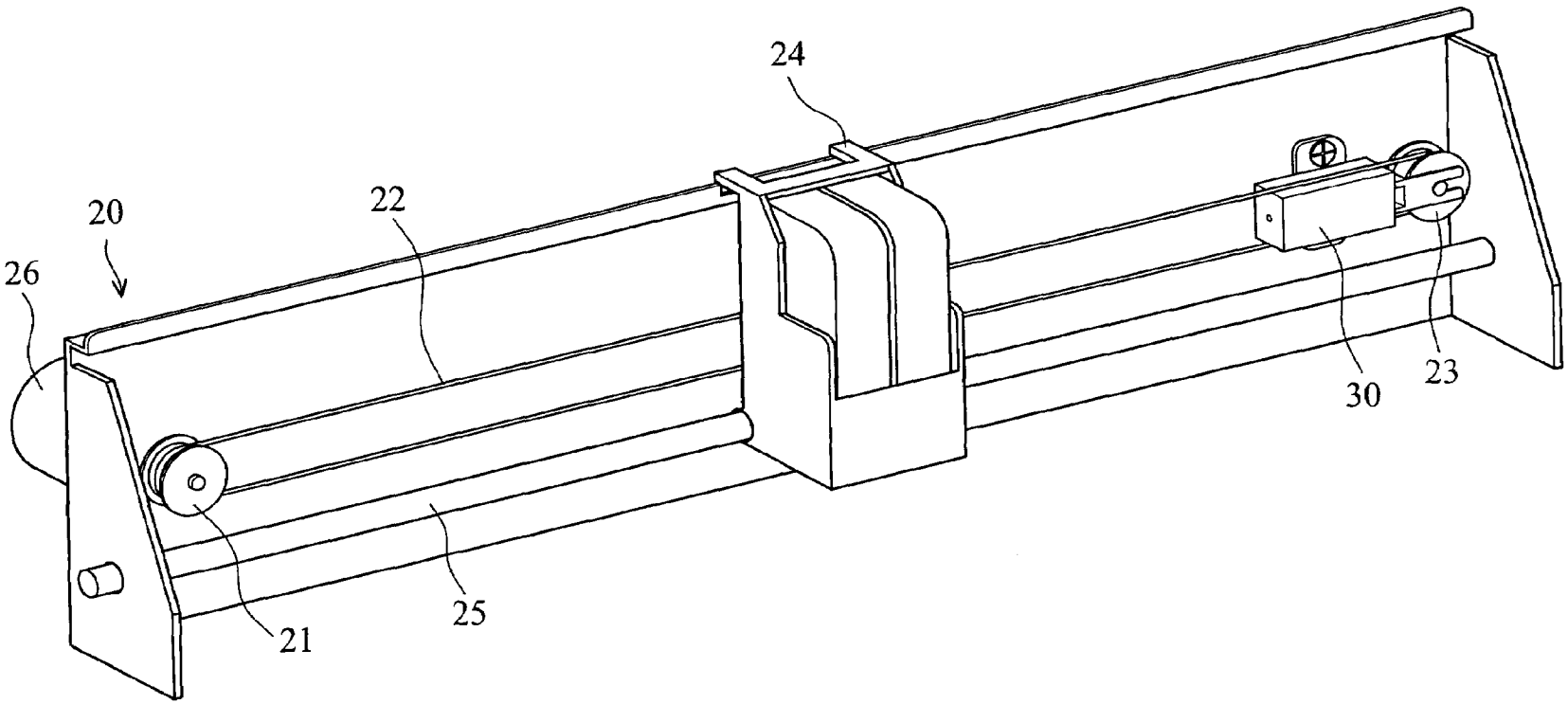
FIG. 2 is a schematic diagram showing a recording head transmission device in accordance with the present invention.

Referring to FIG. 2, an office machine of the present invention includes a main body 20, a driving wheel 21, a transmission belt and a driven wheel 23. In this embodiment, the transmission belt is a belt (leather belt) 22. The belt 22 connects the driving wheel 21 and the driven wheel 23. The driving wheel 21 is powered by a motor 26, and the driving wheel 21 drives the belt 22. A recording head 24 is slidably joined on a shaft 25 in the main body 21 and bound by the belt 22. The recording head 24 is driven by the belt 22 and slides on the shaft 25 to spray ink.

Figure 3:
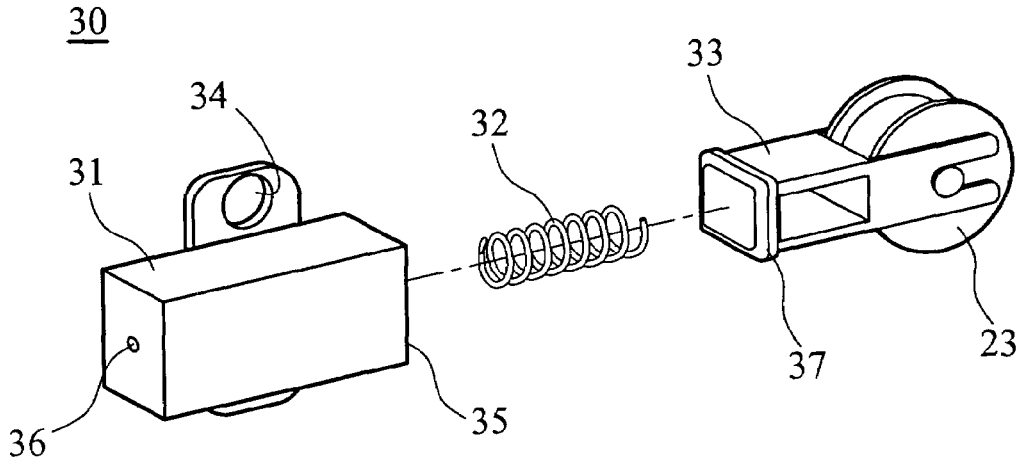
FIG. 3 is an exploded view showing a tension buffer in a first embodiment.

Meanwhile, the driven wheel 23 connects to a tension buffer 30. The tension buffer 30, as shown in FIG. 3, has a sleeve 31, a wheel mount 33, and a resilient member. In the embodiment, the resilient member is a spring 32. The sleeve 31 has a tab 34. The tension buffer 30 is fixed on the main body 20 by a screw or a hook through tab 34. The sleeve 31 has a cavity 35, and the wheel mount 33 is disposed in the cavity 35 and connected to the driven wheel 23. The spring 32 is disposed between the sleeve 31 and the wheel mount 33 to move the wheel mount in the sleeve 31. Otherwise, the sleeve 31 further has a hole 36 and a seal 37 is disposed on the wheel mount 33.

Figure 4:
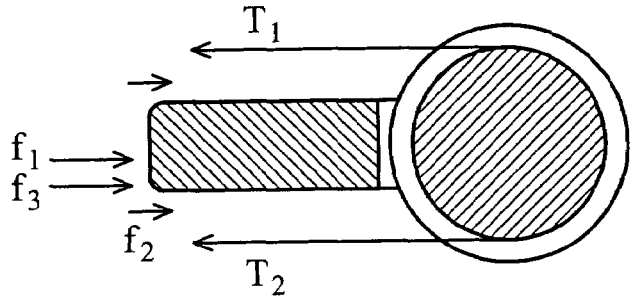
FIG. 4 is a diagram of tension buffer during operation of the office machine.

FIG. 4 shows a free body diagram of tension buffer during operation. When the recording head 24 moves, the mechanical balancing formula is: $T_1+T_2=f_1+f_2+f_3+ma$. Wherein, $T_1$ is tight-side tension; $T_2$ is loose-side tension; $f_1=k(X+\Delta X)$ is the elastic force of the spring, k is the elastic coefficient, x is the original compressed value, $\Delta X$ is the changed compressed value; $f_2$ is friction between the seal 37 and the sleeve 31 wherein the direction is opposite to the direction of wheel mount 33; the value is related to the interference value between the seal and the sleeve, the surface friction coefficient and the lubricant is used; $f_3$ is air resistance wherein the direction is opposite to the direction of wheel mount 33; the value is related to the section of the wheel mount 33 and the hole 36, the section of the wheel mount 33 is direct proportion to the air resistance, and the section of the hole 36 is inversely proportional to the air resistance; the profile of the hole also relates to the air resistance; m is Total mass of driven wheel 23, wheel mount 33 and seal 37; a is the acceleration of the driven wheel 23 driven by the belt 22. According to the above formula, compared with the conventional art, the present invention has spring 32 force, $f_2$; and $f_3$ to cushion belt 22 tensions. When a and $(T_1+T_2)$ are constant, the present invention requires less $f_1$. Thus, the $(X+\Delta X)$ is decreased to prevent the belt from loosening or tensing when the recording head 24 accelerates or decelerates.

Figure 5:
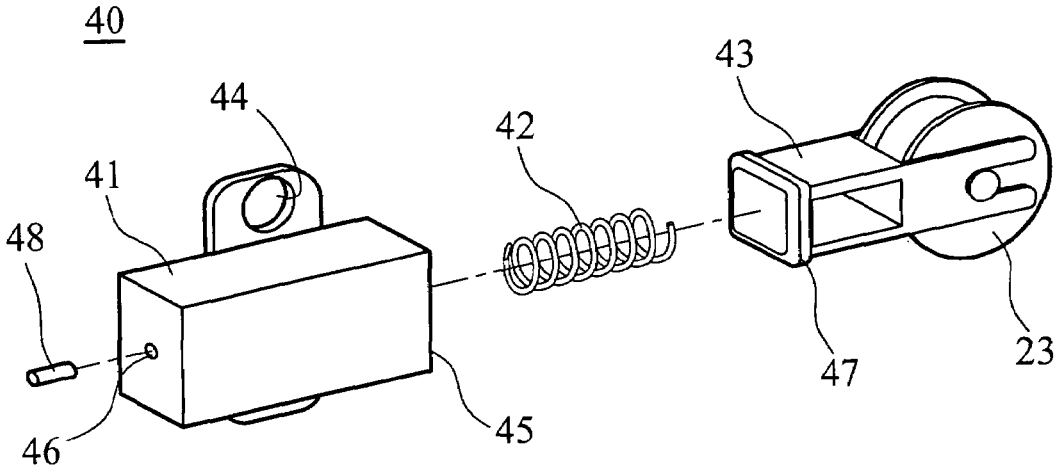
FIG. 5 is an exploded view showing a tension buffer in a second embodiment.

In the embodiment mentioned above, tension buffer 30 is an opening buffer due to hole 36 in sleeve 31. The hole 36 slowly exhausts the air out of the sleeve 31. In a second embodiment, as shown in FIG. 5, a tension buffer 40 includes a sleeve 41, a wheel mount 43, and a spring 42. The sleeve 41 has tabs 44 which the screw passes through to fix tension buffer 40 on the main body 20. The sleeve 41 has a cavity 45. The wheel mount 43 is disposed in the cavity 45 and connects to the driven wheel 23. The spring 42 is disposed between the sleeve 41 and the wheel mount 43 to move the wheel mount 43 in the sleeve 31. Additionally, the sleeve 41 has a hole 46, and a seal 47 disposed on the wheel mount 43 in close proximity to the sleeve 41. The difference between this and the first embodiment is that the office machine further includes a pin 48 blocking the hole 46. The interior of the sleeve 41 becomes a sealed chamber due to the pin 48 and the seal 47. Thus, when the office machine operates, the decrease in volume of the sealed chamber produces large air resistance $f_3$.

Figure 6:
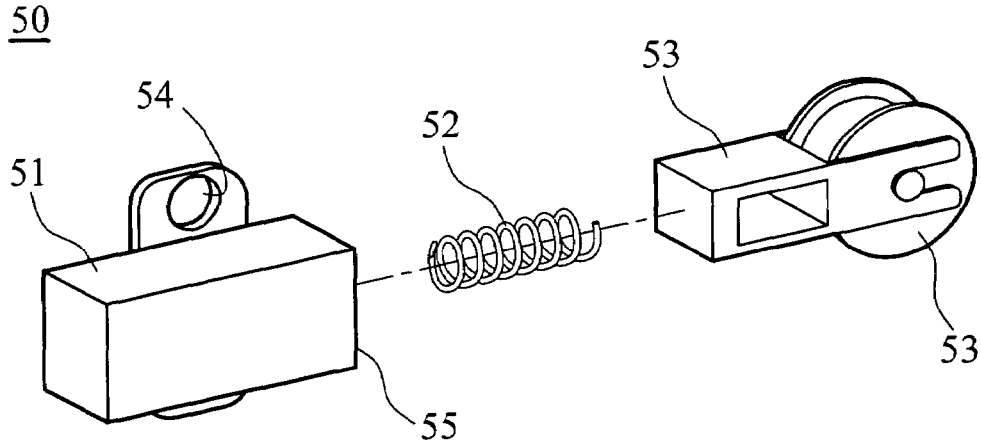
FIG. 6 is an exploded view showing a tension buffer in a third embodiment.

In the first embodiment, tension buffer 30 is an opening buffer due to hole 36 in sleeve 31. The hole 36 slowly exhausts air from the sleeve 31. In a third embodiment, as shown in FIG. 6, a tension buffer 50 includes a sleeve 51, a wheel mount 53, and a spring 52. The sleeve 51 has tabs 54 which the screw passes through to fix tension buffer 50 on the main body 20. The sleeve 51 has a cavity 55. The wheel mount 53 is disposed in the cavity 55 and connects to the driven wheel 23. The spring 52 is disposed between the sleeve 51 and the wheel mount 53 to move the wheel mount 53 in the sleeve 51. The difference between this and the first embodiment is that the sleeve 51 does not have a hole 36, or a seal 37 disposed on the wheel mount 52 near the sleeve 51, neither. A gap (not shown) is formed between the wheel mount 52 and the sleeve 51. Therefore, when the wheel mount 52 moves in the sleeve 51, the gap provides the same function as the hole 36 of the first embodiment. Thus, the gap enables induction or exhaustion of air.

The office machine of the present invention has the following advantages. The sleeve in tension buffer aids in cushioning the resilient member to prevent large and rapid deformation caused by the belt. When the transmission belt moves with near uniformity, the resilient member is powerful to push the driven wheel to its point of origin. Thus, the present invention operates at higher speed and reduces acceleration and deceleration time, allowing the recording head to move quickly. Further, the tension buffer is applicable not only to an office machine, but may also be employed in a scanner or a printer. In other words, a print head of the printer or a scan module of the scanner may employ the tension buffer of the present invention.

Finally, while the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An office machine, comprising:

a main body;

a shaft disposed on the main body;

a recording head slidably disposed on the shaft;

a driving wheel disposed on a first end of the main body;

a driven wheel disposed on a second end of the main body;

a tension buffer disposed on the main body and having a sleeve, a wheel mount and a resilient member, wherein the sleeve is disposed on the main body and has a cavity, the wheel mount is disposed in the cavity and connected to the driven wheel, and the resilient member is disposed between the sleeve and the wheel mount and biases the sleeve and the wheel mount to move the wheel mount in the sleeve; and a transmission belt connecting the driving wheel and the driven wheel and the recording head bound thereon, wherein the driving wheel drives the transmission belt such that the recording head slides on the shaft.

2. The office machine as claimed in claim 1, further comprising a seal disposed on the wheel mount such that the cavity is sealed by the wheel mount and the seal.

3. The office machine as claimed in claim 1, wherein the sleeve has a hole.

4. The office machine as claimed in claim 3, further comprising a pin blocking the hole.

5. The office machine as claimed in claim 1, further comprising a fastener and a tab disposed on the sleeve, wherein the fastener fixes the tension buffer on the main body through the tab.

6. The office machine as claimed in claim 5, wherein the fastener is a screw or a hook.

7. The office machine as claimed in claim 1, wherein the resilient member is a spring.

8. The office machine as claimed in claim 1, wherein the office machine is a printer and the recording head is a print head.

9. The office machine as claimed in claim 1, wherein the office machine is a scanner and the recording head is a scan module.

10. The office machine as claimed in claim 1, wherein the transmission belt is a belt.

11. The office machine as claimed in claim 1, wherein the sleeve and wheel mount are arranged to trap air inside the cavity between the sleeve and the wheel mount such that air resistance is generated by the trapped air when the wheel mount is moved in the sleeve.

12. The office machine as claimed in claim 11, further comprising a hole in the sleeve communicating the cavity with the ambient, wherein the sleeve, wheel mount and hole are arranged such that air trapped in the cavity is vented out of the cavity through the hole when the resilient member is compressed by the wheel mount.

13. The office machine as claimed in claim 1, further comprising a seal disposed on the wheel mount, wherein the sleeve, wheel mount and seal are arranged to trap air inside the cavity between the sleeve and the wheel mount such that air resistance is generated by the trapped air when the wheel mount is moved in the sleeve.

14. The office machine as claimed in claim 13, further comprising a hole in the sleeve communicating the cavity with the ambient, wherein the sleeve, wheel mount, seal and hole are arranged such that air trapped in the cavity is vented out of the cavity through the hole when the resilient member is compressed by the wheel mount.

* * * * *